US007806756B2

(12) United States Patent
Umeda

(10) Patent No.: US 7,806,756 B2
(45) Date of Patent: Oct. 5, 2010

(54) COIN RECEIVING DEVICE IN COIN PROCESSING APPARATUS

(75) Inventor: Masayoshi Umeda, Saitama (JP)

(73) Assignee: Asaji Seiko Co., Ltd., Tokyo (JP)

( * ) Notice: Subject to any disclaimer, the term of this patent is extended or adjusted under 35 U.S.C. 154(b) by 442 days.

(21) Appl. No.: 11/610,079

(22) Filed: Dec. 13, 2006

(65) Prior Publication Data

US 2007/0149102 A1 Jun. 28, 2007

(30) Foreign Application Priority Data

Dec. 27, 2005 (JP) ..... 2005-375385

(51) Int. Cl.
*G07D 1/00* (2006.01)

(52) U.S. Cl. ..... 453/56; 453/7; 453/11

(58) Field of Classification Search ..... 453/7, 453/11, 56; 198/620, 622, 626
See application file for complete search history.

(56) References Cited

U.S. PATENT DOCUMENTS 6,086,472 A * 7/2000 Furukawa ..... 453/3
2005/0042981 A1* 2/2005 Umeda ..... 453/11
2007/0072535 A1* 3/2007 Iwami et al. ..... 453/56

FOREIGN PATENT DOCUMENTS

JP 2000-293730 10/2000
JP 3325706 7/2002

* cited by examiner

*Primary Examiner*—Jeffrey A Shapiro
(74) *Attorney, Agent, or Firm*—McGlew and Tuttle, P.C.

(57) ABSTRACT

A coin receiving device in a coin processing apparatus is provided with a flat belt stretched around a pair of rollers substantially horizontally. A reverse rotation roller is disposed above the flat belt so that it is parallel with the axial line of the rollers, and the lower circumferential face is separated from the flat belt by a distance which is larger than thickness of a coin. A movable restrictor is disposed above the reverse rotation roller, which extends upstream of the flat belt in substantially parallel with the flat belt. A distance between the movable restrictor and the top face of the flat belt is smaller than a diameter of a coin having the largest diameter. The movable restrictor is convex toward an upstream direction of the flat belt. The movable restrictor is replaceably attached to a frame.

15 Claims, 8 Drawing Sheets

COIN RECEIVING DEVICE IN COIN PROCESSING APPARATUS

CROSS REFERENCE TO RELATED APPLICATIONS

This application claims the benefit of priority under 35 U.S.C. §119 of JAPAN Patent Application JP 2005-375385 filed Dec. 27, 2005, the entire contents of which are incorporated herein by reference.

FIELD OF THE INVENTION

The present invention relates to a coin receiving device in a coin processing apparatus and more specifically relates to a coin receiving device capable of preventing received coins from hopping over a reverse rotation roller, provided for breaking stacked coins, and bouncing out through a coin receiving port. In this regard, the present invention relates to a coin receiving device capable of preventing coins from hopping over a reverse rotation roller and bouncing out through a coin receiving port without increasing the height of the coin processing apparatus. The coin processing apparatus according to the present invention embraces a coin accepting apparatus, a coin recycling apparatus and the like wherein in this text the term coin refers for example to coins, tokens, disks, medals or similar disk type media.

BACKGROUND OF THE INVENTION

From Japanese Patent No. 3325706 (FIGS. 2, 4 and 5, p. 3) and Japanese Unexamined Patent Publication JP-2000-293730 (FIGS. 3 and 4, pp. 2-5) it is known to provide an arrangement in which a reverse rotation roller is disposed, so that a circumferential face of a lower end is separated from a flat belt by a distance which is larger than the thickness of a single coin. In this conventional apparatus, when the flat belt advances in a coin input direction, the lower circumferential face of the reverse rotation roller advances in the direction opposite to the coin input direction. Therefore, coins that are conveyed in a stack on the flat belt are prevented from advancing by the reverse rotation roller and are dragged down on the flat belt.

When coins clog between the flat belt and the reverse rotation roller, the clogging of coins is eliminated by advancing the flat belt in the direction opposite to the coin input direction, and rotating the reverse rotation roller in the same direction or stopping the reverse rotation roller. Further, a partition wall is disposed above the reverse rotation roller at generally right angles, so that the coin that is drawn up while leaning against the reverse rotation roller and about to hop over the same is returned onto the flat belt by the partition wall. As such, the coin leaning against the reverse rotation roller moves synchronously with rotation of the reverse rotation roller by the frictional force with respect to the reverse rotation roller and tends to hop over the reverse rotation roller. The coin brought up by the reverse rotation roller will drop on the flat belt because the advance of the coin is prevented by the partition wall.

It is desirable for a coin processing apparatus to be as small as possible since such a coin processing apparatus is usually placed in the vicinity of, for example, a point of sale (POS) register in supermarkets, gas stations and the like. In the conventional apparatus, however, the partition wall should be arranged generally at right angles above the reverse rotation roller, at a predetermined height, concretely at a height which is equal to or larger than at least the diameter of the largest coin, so that possibilities as to a reduction in height are limited. As a measure for solving this problem, arranging a hopping-over preventing plate extending substantially horizontally right above the reverse rotation roller in a stationary state is expected. In this case, the flat belt and the hopping-over preventing plate should be separated by a distance which is larger or equal to the diameter of a coin having the largest diameter. This also limits reduction of height. This is because when a coin having the largest diameter is sandwiched between the flat belt and the hopping-over preventing plate while it is standing, the hopping-over preventing plate may be pushed up by the coin to be damaged, and the coin may not be smoothly returned onto the flat belt.

SUMMARY OF THE INVENTION

It is a first object of the present invention to provide a coin receiving device allowing for a smaller height for a coin processing apparatus.

It is a second object of the present invention to provide a coin receiving device having a smaller height with the coin receiving device being low in cost.

It is a third object of the present invention to provide a coin receiving device of smaller height which allows easy replacement.

In order to achieve the above objects, the coin receiving device according to the present invention includes a coin processing apparatus, which comprises a conveyor, and a reverse rotation roller disposed above the conveyor while keeping a gap of one coin or more, in which movement of coins conveyed in a stack on the conveyor is restricted by the reverse rotation roller. A movable restrictor is arranged above the reverse rotation roller.

In this configuration, when coins stacked in bulk are supplied onto the conveyor, the coins stacked in bulk reach the reverse rotation roller with movement of the conveyor. The interval between the conveyor and the reverse rotation roller is more than or equal to the thickness of one coin. Therefore, when coins are stacked, the overlaying coin(s) is (are) prevented from advancing by reverse rotation of the reverse rotation roller, and is relatively pushed onto the conveyor. Therefore, the coin that is directly lying on the conveyor moves together with the conveyor, and is conveyed to the next step while passing between the conveyor and the reverse rotation roller as described above. The coin that lies on another coin on the conveyor is dragged down from on the other coin to drop on to the conveyor and come into surface contact with the conveyor, and pass between the conveyor and the reverse rotation roller. When the coin leans against the reverse rotation roller, and is prevented from moving by rotation of the reverse rotation roller, and stands on the conveyor, an upper end of the coin is prevented from advancing by the movable restrictor. A lower end of the coin which is prevented from advancing is moved by movement of the conveyor, and the coin stands upright between the conveyor and the movable restrictor, and is finally turned back to be brought into surface contact with the conveyor, so that it will pass between the conveyor and the reverse rotation roller while being conveyed between the conveyor and the reverse rotation roller. Therefore, an advantage arises that a coin is prevented from hopping over the reverse rotation roller without having to provide an upright partition wall. When a coin stands up as described above, a push-up force is exerted on the movable restrictor. However, since the movable restrictor is movable, it is advantageously pushed up by the push-up force and will not be damaged.

The invention may also provide that the movable restrictor is formed of an elastic body in the coin receiving device in a coin processing apparatus. In this configuration, since the movable restrictor is an elastic body, the movable restrictor is movable regardless of the position of the movable restrictor with which a coin comes into contact. Therefore, the coin leaning against the reverse rotation roller is prevented from moving with the reverse rotation roller by restriction of movement at its upper end by the movable restrictor, while it is moved together with the conveyor at the lower end of the coin and turned back to come into surface contact with the belt. The coin then moves together with the conveyor and passes between the conveyor and the reverse rotation roller. Therefore, an advantage arises that the movable restrictor will not be damaged.

The invention may also provide that the movable restrictor is formed of a light-transmissive elastic body in the coin receiving device in a coin processing apparatus. According to this configuration, since the movable restrictor arranged right above the reverse rotation roller is a transmissive elastic body, the coin is prevented from bouncing out and the reverse rotation roller can be visually checked. Therefore, an advantage arises that the surface condition and the rotation condition of the reverse rotation roller can be checked.

According to another aspect of the invention, a coin processing apparatus is provided comprising a flat belt stretched around a pair of rollers substantially horizontally with a reverse rotation roller disposed above the flat belt so that it is parallel with the axial line of the rollers thereof. A lower circumferential face is separated from the flat belt by a distance which is larger than the thickness of a coin. A movable restrictor is disposed above the reverse rotation roller, which extends upstream of the flat belt in substantially parallel with the flat belt.

According to this configuration, when coins are supplied onto the flat belt in bulk, the bulk stacked coins reach the reverse rotation roller by the advancement of the flat belt. The interval between the flat belt and the reverse rotation roller is more than or equal to the thickness of a single coin. Therefore, when coins are stacked on the flat belt, the overlaying coin is prevented from advancing by the reverse rotation of the reverse rotation roller, and is relatively pushed onto the conveyor. Therefore, the coin that is directly lying on the flat belt moves together with the flat belt, and is conveyed to the next step while passing between the flat belt and the reverse rotation roller. The coin that lies on another coin is dragged down from on the other coin to drop on the flat belt, and thereby comes into surface contact with the flat belt, and passes between the flat belt and the reverse rotation roller as described above. When the coin leans against the reverse rotation roller, and is prevented from moving by rotation of the reverse rotation roller, the lower end of the coin is moved with the advance of the flat belt, and the coin stands upright between the flat belt and the movable restrictor, and finally is turned back to come into surface contact with the flat belt. Thus the coin moves together with the flat belt and passes between the flat belt and the reverse rotation roller. The advantage arises that a coin is prevented from hopping over the reverse rotation roller without having to provide an upright partition wall. When a coin stands up at right angels, a push-up force is exerted on the movable restrictor. However, since the movable restrictor is movable, it is advantageously pushed up by the push-up force and will not be damaged.

The invention may also be provided such that a distance between the movable restrictor and the top face of the flat belt is smaller than a diameter of a coin having the largest diameter in the coin receiving device in a coin processing apparatus. According to this configuration, the height of the device depends on the position of the movable restrictor. With this construction the height of the device can be further reduced.

The movable restrictor may be formed into a convex shape toward an upstream direction of the flat belt in the coin receiving device in a coin processing apparatus. In this configuration, the projecting length to upstream side of the flat belt of the movable restrictor opposing to the center part of the flat belt is long. Further, both ends of the movable restrictor will not be angulated. Therefore ends of the movable restrictor have a small spring constant, and are easily deformed by a standing coin. This presents the advantage that the coin is turned back at an early stage, and brought into surface contact with the flat belt.

The invention may also be provided such that the movable restrictor is replaceably attached to a frame in the coin receiving device in a coin processing apparatus. With this configuration, when the movable restrictor is abraded or damaged, it can be readily replaced.

The invention is advantageously embodied as a coin receiving device in a coin processing apparatus. The coin receiving device comprises a flat belt stretched around a pair of rollers substantially horizontally, with a reverse rotation roller disposed above the flat belt so that it is parallel with the axial line of the rollers. A lower circumferential face is separated from the flat belt by a distance which is larger than the thickness of a coin. A movable restrictor is disposed above the reverse rotation roller, which extends upstream of the flat belt, substantially parallel with the flat belt. A distance between the movable restrictor and the top face of the flat belt is smaller than a diameter of a coin having the largest diameter, the movable restrictor is formed into a convex toward upstream of the flat belt, and the movable restrictor is replaceably attached to a frame.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
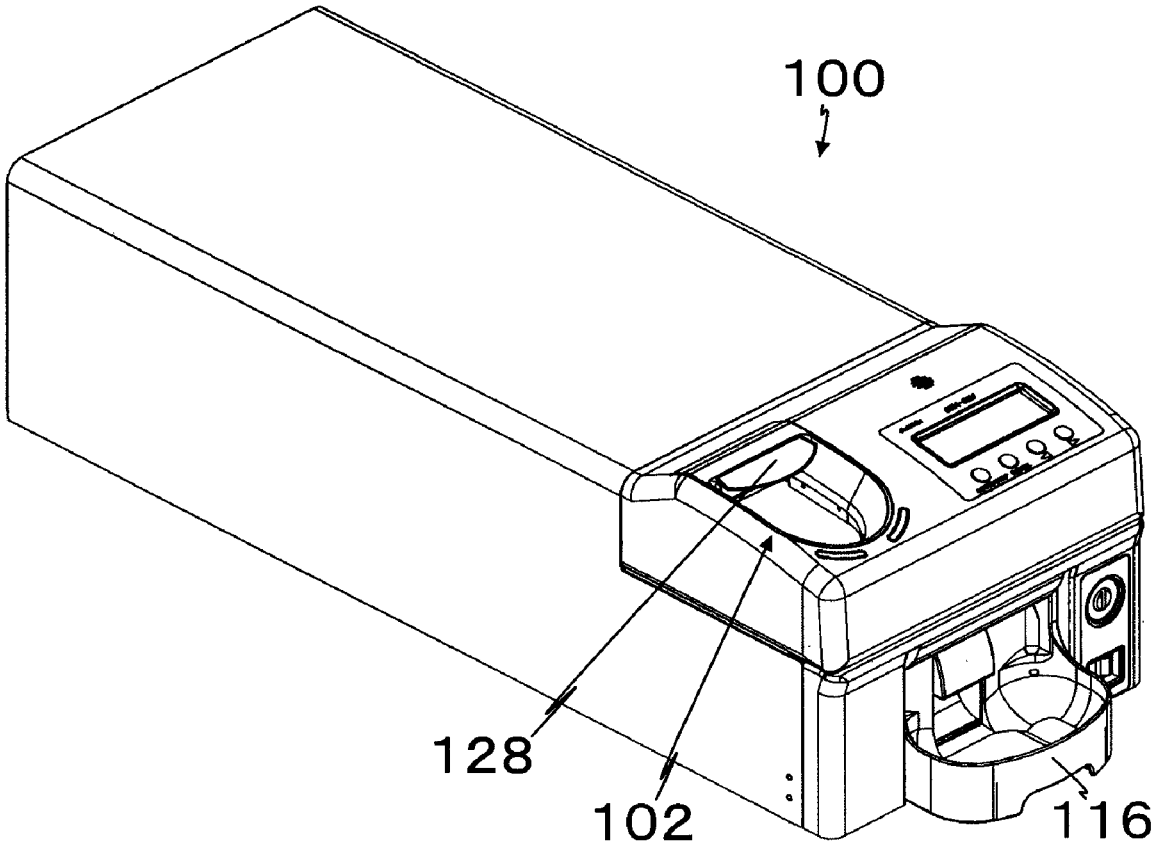
FIG. 1 is a perspective view of a coin recycling apparatus in which a coin receiving device according to the first embodiment of the present invention is used.

Referring to the drawings in particular, the first embodiment is a coin receiving device in a coin recycling apparatus provided as a coin processing apparatus in which plural denominations of coins (e.g., eight—i.e., 2-euro, 1-euro, 50-cent, 20-cent, 10-cent, 5-cent, 2-cent and 1-cent which are currency of the European Union or e.g., six—i.e., 1-U.S. dollar, 50-cent, 20-cent, 10-cent, 5-cent, and 1-cent) are retained by denomination, and a desired number of desired denomination of coins are dispensed in accordance with a dispensing instruction.

The coin processing apparatus includes the coin receiving machine which receives a plurality of denominations of coins and stores them by denomination. An overview of a coin recycling apparatus 100 will be explained with reference to FIGS. 1 and 2. The coin recycling apparatus 100 includes a coin receiving device 102, a separating/delivering device 104, a denomination determining device 106, a conveying device 108, a sorter 110, a retainer 112, a dispensing device 114 and a dispensing tray 116.

The coin receiving device 102 has the function of sending out coins of plural denominations introduced in bulk into a D-shaped coin receiving port 118 to the separating/delivering device 104 of the next step in such an amount that will not inhibit the function of the separating/delivering device 104. The coin receiving device 102 includes a receiver 120, a conveyor 122, a reverse rotation roller 124 and an electric motor 126 for driving the conveyor 122 and a movable restrictor 128.

First, the conveyor 122 will be explained. The conveyor 122 has a function of conveying input coins to the next step. The conveyor 122 is implemented by a flat belt 130 in the present embodiment. The flat belt 130 has a width which is slightly wider than twice the maximum coin diameter, and is stretched around a pair of rollers 132, 134 so that it is slightly inclined upwardly in the downstream direction. However, the flat belt 130 may be horizontal. The flat belt 130 is movable in a delivering direction and in an opposite returning direction in which coins are fed to the next step, by normal rotation and reverse rotation of the electric motor 126.

Next, the reverse rotation roller 124 will be explained. The reverse rotation roller 124 has a function of preventing advancement of the coins conveyed in stack and dragging down them when the flat belt 130 is traveling in the delivering direction. The reverse rotation roller 124 is arranged above the downstream end of the flat belt 130 while keeping a restriction clearance 136 with respect to the flat belt 130. The restriction clearance 136 is slightly smaller than three times the thickness of the thinnest coin and is somewhat larger than the thickness of a single thickest coin. The reverse rotation roller 124 is so configured that the bottom face thereof rotates in the direction opposite to the traveling direction of the flat belt 130 when the flat belt 130 travels in the conveyance direction to the next step, and that it is in a stationary state when the flat belt 130 moves in the returning direction.

However, when the flat belt 130 moves in the returning direction, the rotation may be such that the bottom face of the reverse rotation roller 124 returns to the same direction. As a result, when a stack of three or more of the thinnest coins on the flat belt 130 reach the reverse rotation roller 124, the uppermost coin is prevented from advancing by the reverse rotation roller 124, and is relatively moved in the returning direction and dragged down, which realizes a restriction for preventing quantities of coins from being supplied at once to the separating/delivering device 104. In this case, the restriction clearance 136 may be set to have a size which is equal to or larger than the thickness of one thinnest coin but less than two thinnest coins.

Next, the receiver 120 will be explained. The receiver 120 has a cylindrical shape formed of a ring extending in the vertical direction, and the upper opening of the cylinder forms a receiving port 138 and the lower opening forms a delivering port 140. The receiver 120 has the function of retaining coins received in bulk on the conveyor 122.

Next, the delivering port 140 will be explained. The delivering port 140 is disposed above the flat belt 130 at an interval which is smaller than the thickness of a thinnest coin from the top face of the flat belt 130. A left wall 142 and a right wall 144 defining left and right limits of the delivering port 140 are arranged in parallel at an interval which is slightly wider than twice the diameter of the largest coin to be received, thereby forming walls which are substantially perpendicular to the top face of the flat belt 130. By setting the interval between the left wall 142 and the right wall 144 to be slightly longer than twice the largest diameter, coins will not be jammed while sandwiched between the left and the right walls, and an advantage arises that coins can be readily taken out. Preferably, the height of the left wall 142 and the right wall 144 is as small as possible in order to prevent a coin from standing on the flat belt 130.

The rear ends of the left wall 142 and the right wall 144 are connected via an arcuate rear wall 146. As a result, the coin that stands while leaning against the left wall 142 or the right wall 144 can be guided to the center part of the flat belt 130 along the rear wall 146 by causing the flat belt 130 to travel in the direction opposite to the delivering direction, and then the standing coin can be brought into surface contact with the flat belt 130 by causing the flat belt 130 to travel in the delivering direction.

The receiving port 138 is similar in shape to the delivering port 140 and is larger than the delivering port 140. The receiving port 138 and the left wall 142, the right wall 144 and the rear wall 146 are connected via a slant face 148. By making the receiver 120 into a flask conical shape with the slant face 148, the user may easily input a coin because of the larger receiving port 138. This presents the advantage that a quantity of coins received can be increased.

On opposing surfaces of the left wall 142 and the right wall 144, there is provided a plurality of installation holes 152 for a light emitter and a light receiver of a photoelectric sensor 150 serving as a coin sensor. The photoelectric sensor 150 is arranged so that its optical axis transverses slightly above the flat belt 130 below the receiving port 138, to constitute a coin input detecting device 154. When the optical axis of the coin input detecting device 154 is blocked, it is regarded as a coin being inputted, and the motor 126 is activated to move the flat belt 130 in the delivering direction. When a full sensor 156 of the separating/delivering device 104 as will be described later detects a full condition, the motor 126 is stopped. Therefore, the separating/delivering device 104 is able to stably separate and deliver coins one by one without receiving coins exceeding the full amount from the coin receiving device 102. The coin input detecting device 154 can be used alternatively to or in combination with a magnetic sensor disposed on the lower side of the flat belt 130.

Next, the movable restrictor 128 will be explained. The movable restrictor 128 has the function of preventing coins in the receiver 120 from being discharged through the receiving port 138 by rotation of the reverse rotation roller 124. The movable restrictor 128 is molded from a sheet 160 having elasticity and is formed into a rectangular shape having a transverse width which is substantially the same width of the receiving port 140. The sheet 160 is preferably light transmissive. Therefore, the sheet 160 is preferably molded of polyurethane. This allows observation of the contact condition between the reverse rotation roller 124 and a coin. The sheet 160 is preferably formed into such an arcuate shape that the upstream end of the flat belt 130 is convex in the center when attached to the receiver 120. This is effective for preventing shear drop on the both ends of the sheet 160, decreasing the spring constant, and making the sheet body 160 easy to deform. The upstream end of the sheet 160 is secured to the receiver 120 by securing means 162 right above the reverse rotation roller 124 and arranged substantially horizontally. Therefore, it forms a wedge-like space together with the flat belt 130 which is inclined upwardly.

Next, the securing means 162 will be explained. The securing means 162 has a function of securing a part of the sheet 160 to the receiver 120, and is formed of a securing frame 164 and a holder 166 which are parts of the receiver 120.

The securing frame 164 will be explained. The securing frame 164 has an angular cross section, and is disposed to transverse the flat belt 130 right above the reverse rotation roller 124. The interval between the lower end of the securing frame 164 and the circumferential face of the reverse rotation roller 124 is set to be smaller than the thickness of the coin having the smallest thickness so as to prevent a coin from advancing between the reverse rotation roller 124 and the securing frame 164. A top face 168 of the securing frame 164 is horizontal and formed with a throughhole 170. In correspondence with the throughhole 170, a fitting hole 172 is formed in an end part of the sheet 160. A holding hole 174 is formed near the fitting hole 172.

Next, the holder 166 will be explained. The holder 166 has the function of holding and pushing an end part of the sheet 160 against the securing frame 164. From the bottom face of a holder part 180 of the holder 166, a L-shaped hook 182 is formed so as to be opposite the through-hole 170. Further, from the bottom face of the holder 166, a protrusion (not shown) that fits into the holding hole 174 projects. For securing the sheet 160 to the receiver 120, the protrusion (not shown) of the holder 166 is fitted into the holding hole 174, and then the hook 182 is inserted into the fitting hole 172 and then inserted into the through hole 170. Thus, the sheet 160 is secured to the frame (not shown) of the coin recycling apparatus 100 in such a manner that one end of the sheet 160 is sandwiched from above and below between the top face 168 of the securing frame 164 and the bottom face of the holder part 180, and the other end is brought into close contact with the receiver 120.

With this structure, since the middle part of the sheet 160 is held substantially horizontally by the top face 168 of the securing frame 164 and the holder part 180, the leading end of the sheet 160 projects horizontally above the flat belt 130. Therefore, the sheet 160 forms a wedge-like space with respect to the top face of the flat belt 130 which inclines upward. The sheet 160 is secured while being prevented from moving transversely by the hook 182 and a protrusion (not shown).

In this condition, the distance between the top face of the flat belt 130 and the bottom face of the sheet 160 is slightly smaller than the diameter of the coin having the largest diameter. Further, the amount of projection of the sheet 160 in the upstream direction of the flat belt 130 is preferably about one third the diameter of coin having the largest diameter. Further, the sheet 160 can be readily replaced by removing the holder 166 from the receiver 120, removing the hook 182 and the protrusion from the fitting hole 172 and the holding hole 174, and attaching a new sheet 160. Therefore, the sheet 160 can be readily replaced in the case of abrasion or damage.

Figure 2:
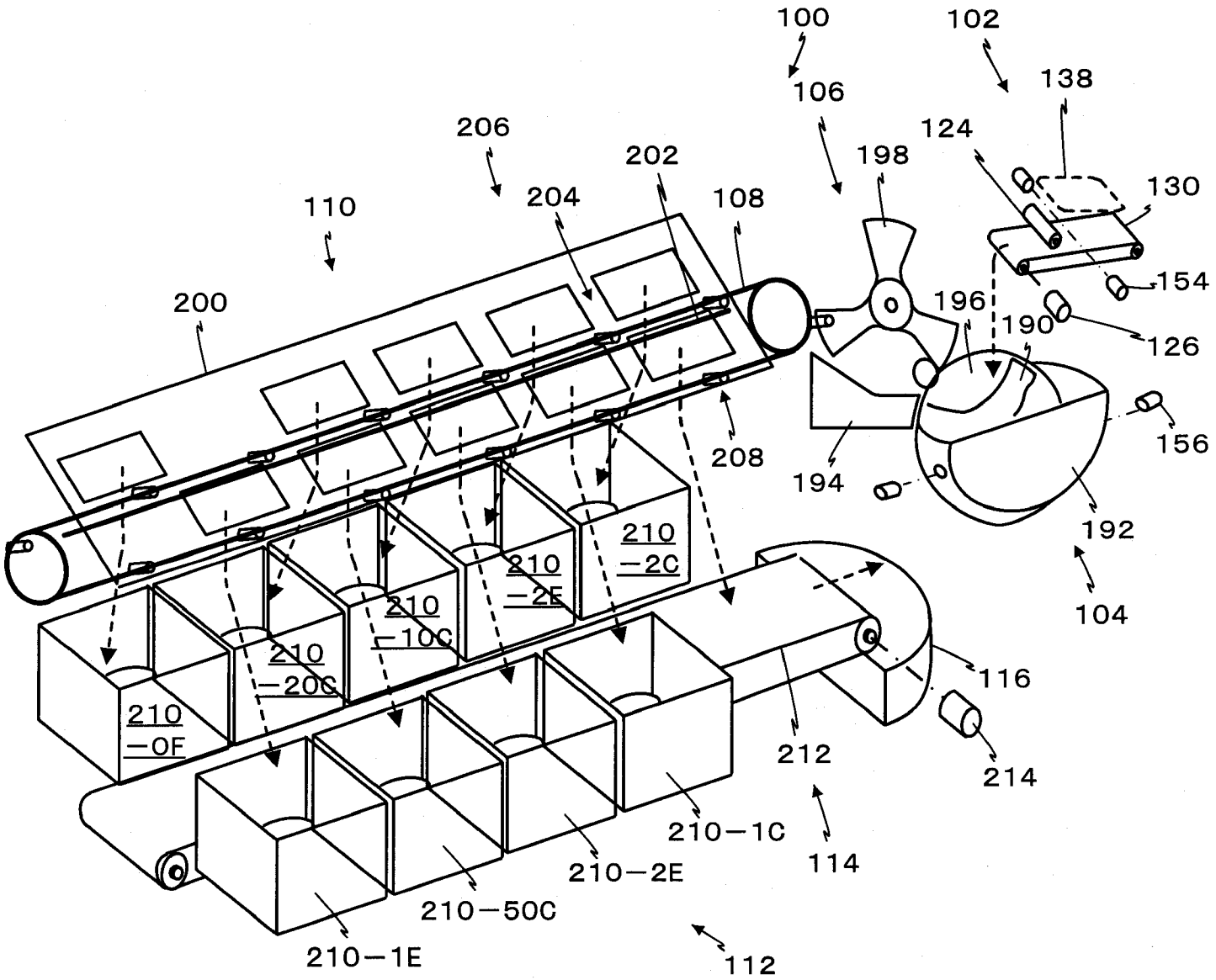
FIG. 2 is a schematic explanatory view of a coin recycling apparatus in which a coin receiving device according to the first embodiment of the present invention is used.
Figure 3:
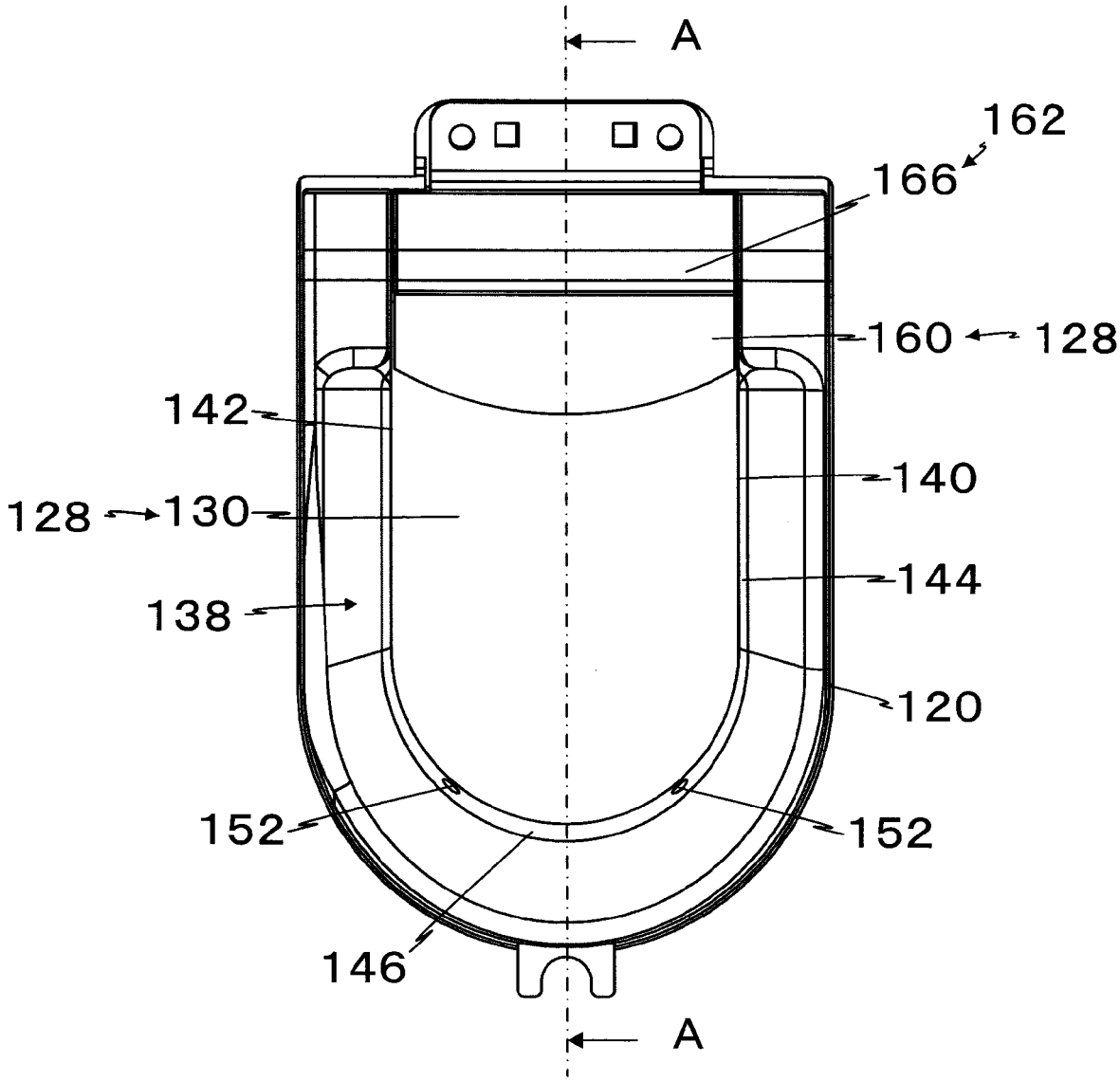
FIG. 3 is a plan view of a coin receiving device according to the first embodiment of the present invention.

Next, the separating/delivering device 104 will be explained. The separating/delivering device 104 has a function of separating coins of plural denominations received in bulk from the coin receiving device 102 and delivering them one by one to the next step. The separating/delivering device 104 is disposed below the coin receiving device 102, and includes a rotary plate 190, a retaining bowl 192, a collector 194 and a full sensor 156, as shown in FIG. 2.

The rotary plate 190 has a receiver 196 that receives coins one by one, and arranged a slant at a predetermined angle and rotated at a predetermined speed. The receiver 196 is dimensioned to be able to receive one coin having the largest diameter but not two coins having the smallest diameter. The receiver 196 of the rotary plate 190 receives coins retained in bulk in a lower part opposing to the storing bowl 192 one by one, and delivers them to the collector 194. The collector 194 is of a knife shape.

The full sensor 156 has a function of outputting a full signal when the amount of coins in the storing bowl 192 reaches a predetermined amount or more, and is implemented, for example, by a transmissive photoelectric sensor. When the full sensor 156 outputs a full signal, the electric motor 126 is stopped, and the supply of coins from the coin receiving device 102 is stopped. When the full sensor 156 no longer outputs a full signal, the electric motor 126 is restarted, and coins on the flat belt 130 are supplied to the storing bowl 192.

Next, the denomination determining device 106 will be explained. The denomination determining device 106 has the function of determining the real/fake status and the denomination of the coins delivered one by one from the separating/delivering device 104. The denomination determining device 106 has the function of determining the real/fake status and the denomination of the coin based on detection data acquired from the magnetic sensor (not shown) in the course of moving the coin by a rotary wiper 198. To be more specific, it has the function of determining the real/fake status and the denomination of the coin based on detection data from a material sensor, a thickness sensor and a diameter sensor of coin.

Next, the conveying device 108 will be explained. The conveying device 108 has the function of conveying coins, that have been determined as to the real/fake status and the denomination, by the denomination determining device 106, to the sorter 110. This has the function of pushing a coin, which is supported at its one face by a slide plate 200 as will be described later and at its circumferential face, by a guide rail 202, and moving it to a predetermined direction.

Next, the sorter 110 will be explained. The sorter 110 has the function of sorting coins moved by the conveying device 108 into predetermined sorting parts according to the denomination. The sorter 110 has a first sorting part 206 disposed above a moving path 204 and along the moving path 204 and a second sorting part 208 disposed below the moving path 204 and along the guide rail 202.

Next, the coin retainer 112 will be explained. The coin retainer 112 has a function of retaining coins sorted according to denomination in the sorter 110, by denomination. In the present embodiment, the coin retainer 112 is structured by two arrays of coin hoppers 210 for dispensing coins one by one by denomination by a rotary disc (not shown), the coin hoppers 210 being disposed below the sorter 110 so as to be opposite to the first sorting part 206 and the second sorting part 208. Each coin hopper is denoted by reference numeral 210 added with a symbol for each denomination.

Next, the dispensing device 114 will be explained. The dispensing device 114 has a function of delivering coins dispensed from the coin hopper 210 for each denomination to the dispensing tray 116. In the present embodiment, the dispensing device 114 is implemented by a flat belt 212 disposed between two arrays of coin hoppers. The flat belt 212 is selectively driven so that the top face moves toward the dispensing tray 116 by an electric motor 214. The coin conveyed by the flat belt 212 is supplied into the dispensing tray 116.

Figure 4:
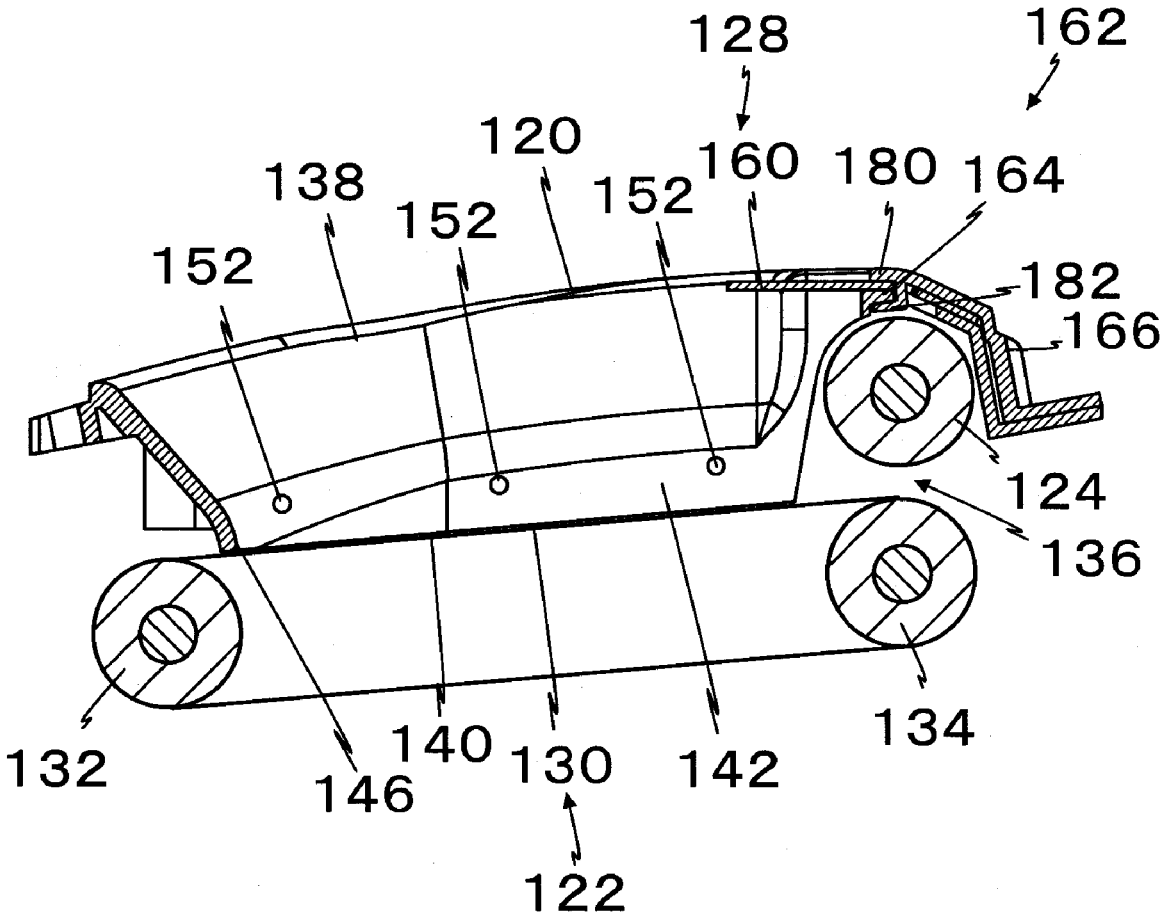
FIG. 4 is a cross sectional view along the line A-A in FIG. 3.
Figure 5:
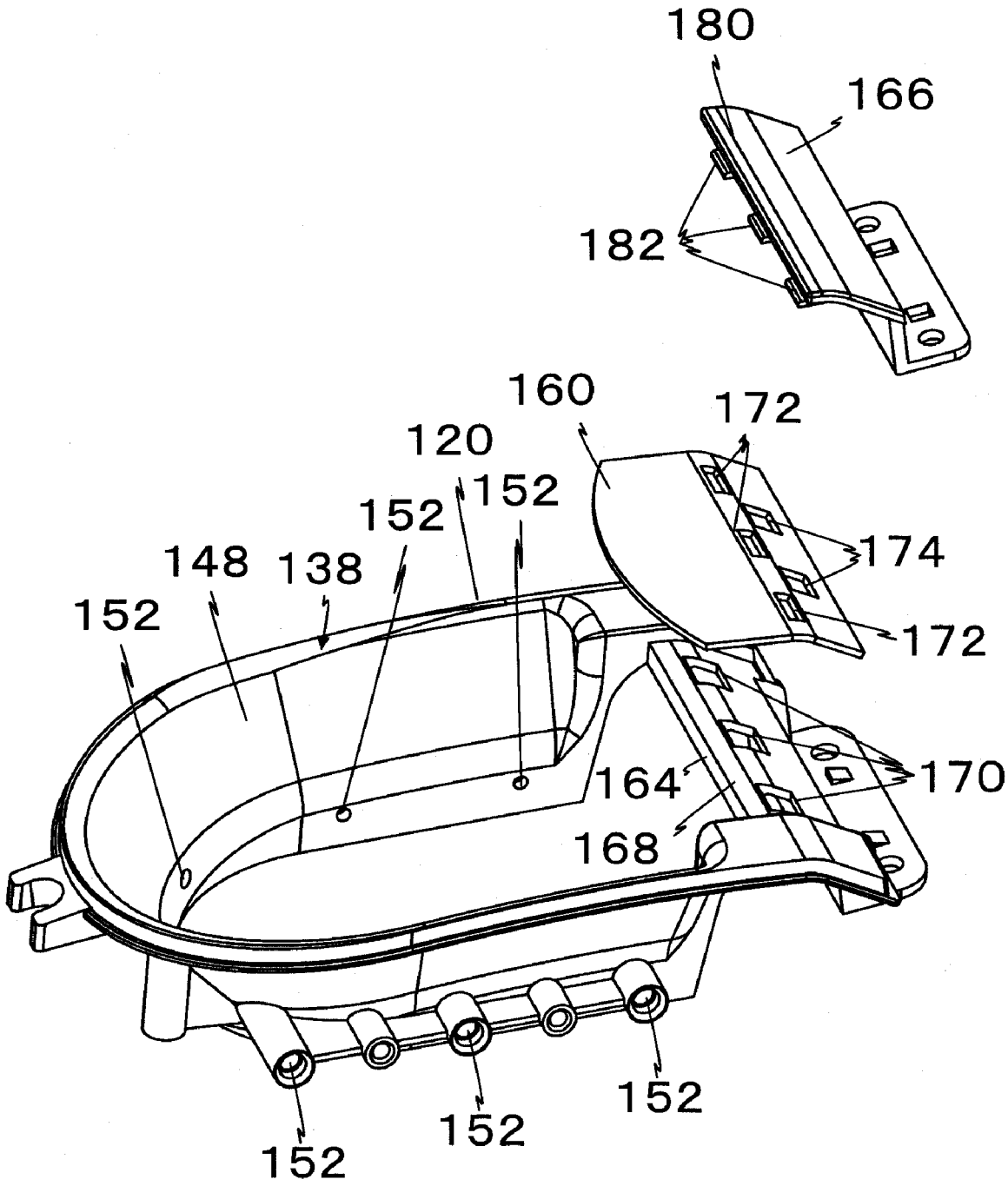
FIG. 5 is an exploded perspective view of a coin receiving device according to the first embodiment of the present invention.

Next, the operation of the present embodiment will be explained with reference to FIGS. 6 and 7. When coins of plural denominations are input through the receiving port 120, the input coins C drop onto the flat belt 130. As a result, the optical axis of the coin detecting device 154 is blocked by the input coins, so that the coin input detection signal is output, and the motor 126 is rotated in response to the coin input detection signal. As a result, the top face of the flat belt 130 moves toward the separating/delivering device 104 (to the right in FIGS. 4, 6 and 7) and the reverse rotation roller 124 is rotated reversely (clockwise in FIGS. 6 and 7). Therefore, when coins C of the smallest thickness are stacked flatly or two such coins C are stacked, the coins C pass below the lower circumferential face of the reverse rotation roller 124, drop from the end part of the coin receiving flat belt 130 and drop into the storing bowl 192 of the separating/delivering device 104.

Figure 6:
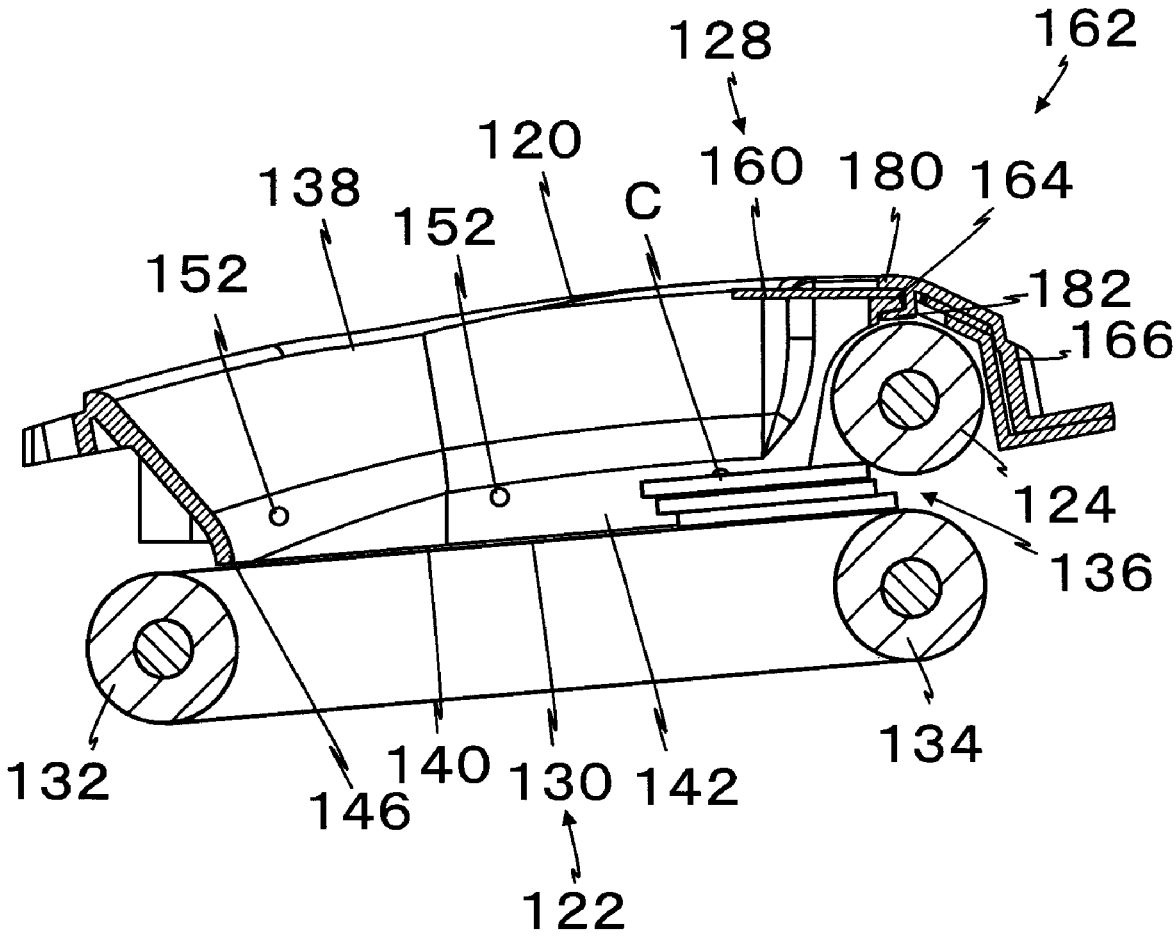
FIG. 6 is an operation explanatory view of a coin receiving device according to the first embodiment of the present invention.

As shown in FIG. 6, when a stack of three coins C is conveyed, the lower circumferential face of the roller 124 moves in opposite direction to the top face of the flat belt 130 since the reverse rotation roller 124 rotates reversely. The stacked coins C, i.e., the two coins C in the present embodiment, pass below the reverse rotation roller 124, and the uppermost coin C is prevented from advancing and is moved relative to the underlying coin C. As a result, the uppermost coin C is shifted relative to the underlying coin C and finally dropped onto the flat belt 130. The dropped coin C is conveyed again toward the separating/delivering device 104 as described above by the traveling of the flat belt 130. When the coin input detecting device 154 no longer detects coin C, the motor 126 is stopped and movement of the flat belt 130 is stopped.

Figure 7:
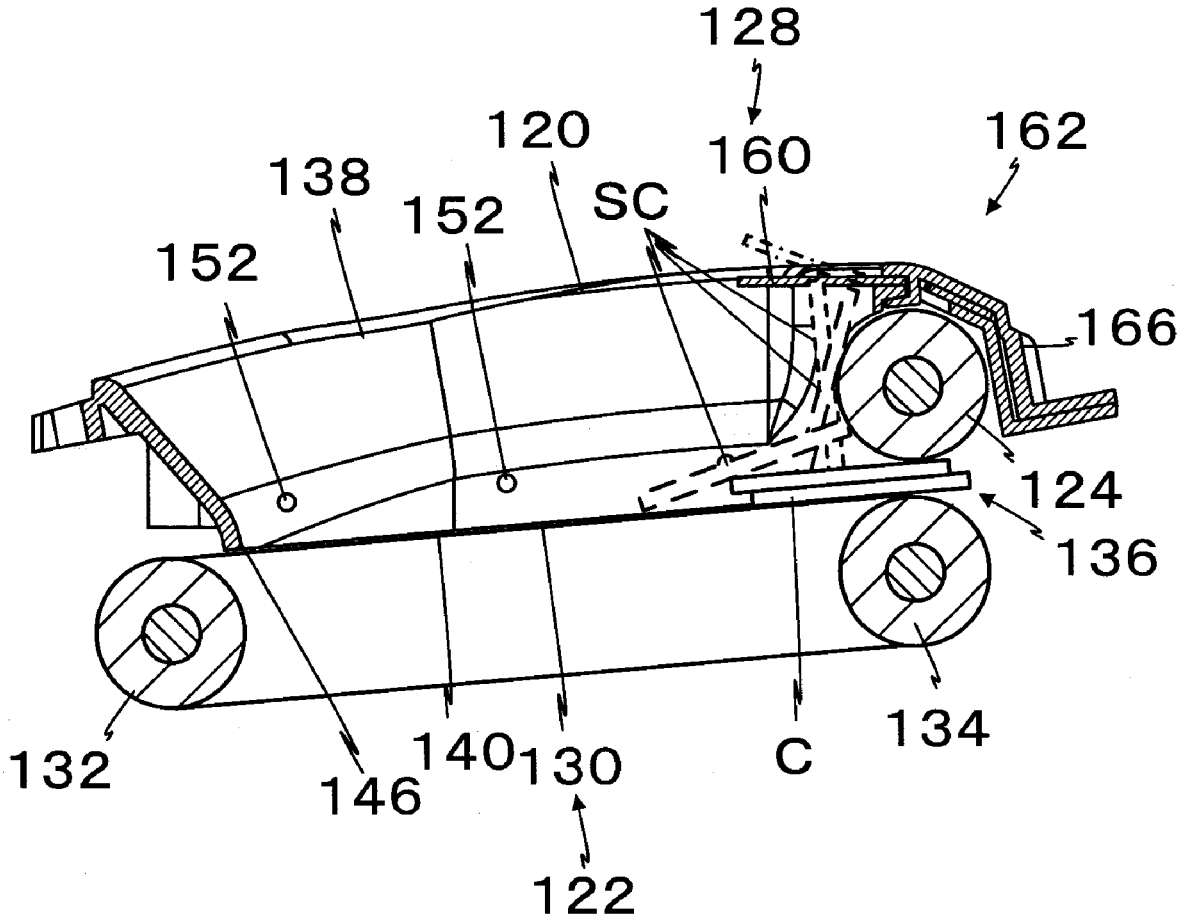
FIG. 7 is an operation explanatory view of a coin receiving device according to the first embodiment of the present invention.

As described above, when the upper coin C is shifted relative to the underlying coin C, the shifted coin C may be inclined while leaning against the stacked coin C (reference mark SC in FIG. 7). In this case, the leading end of the coin SC comes into contact with the circumferential face of the reverse rotation roller 124 and the back side of the coin C may come into contact with the reverse rotation roller 124. As a result, the coin SC receives lifting force by rotation of the reverse rotation roller 124 and moves upward.

In this case, the leading end of the coin SC pushes up and deforms the sheet 160 disposed immediately above the reverse rotation roller 124. Therefore, the coin SC will not fly out externally of the receiving port 138 over the reverse rotation roller 124 because movement of the coin SC is inhibited. The coin SC is prevented from moving by the reverse rotation roller 124 at its middle part, and the lower end is forcedly moved toward below the reverse rotation roller 124 by the flat belt 130. Therefore, the coin SC is finally turned back and brought into surface contact with the flat belt 130 and into flatly stacked condition. As a result, the inclined coin: SC passes through a restriction gap 136 and moves to the next step. According to the above first embodiment, since there is no need to arrange an upright wall above the reverse rotation roller 124 as described above, it is possible to reduce the height of the upright wall. Further, according to the first embodiment, the sheet 160 is bent by a coin having the largest diameter. In other words, since the sheet 160 is disposed near the conveyor 122, it is possible to further reduce the height of the apparatus. Further, since the sheet 160 is flexible, there arises an advantage that it will not be damaged even in the case of deformation by a coin having the largest diameter.

Figure 8:
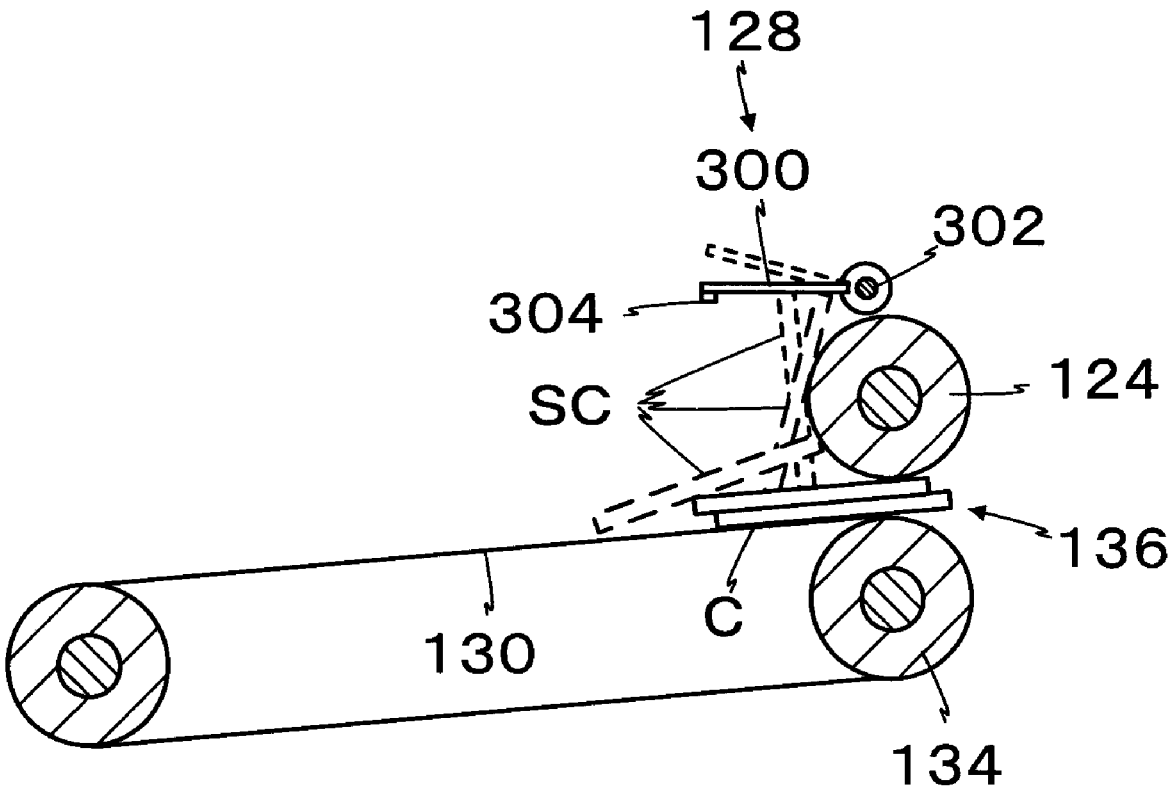
FIG. 8 is an explanatory view of a coin receiving device according to the second embodiment of the present invention.

The second embodiment is a modified embodiment of the movable restrictor 128. FIG. 8 is an explanatory view of a coin receiving device according to the second embodiment of the present invention.

The movable restrictor 128 according to the second embodiment is rotatably attached to a stationary axis 302 in which a restriction plate 300 of rigid body is disposed above the reverse rotation roller 124, and has rotating force in the counterclockwise direction in FIG. 8 owing to the self moment.

The restriction plate 300 is held substantially horizontal by a stopper 304 projecting from the receiver 120. The restriction plate 300 is rotated clockwise in FIG. 8 about the stationary axis 302 against the moment when it is pushed up by the coin SC. Therefore, the coin SC is turned back and thus is able to pass through the restriction gap 136 as is the case with the first embodiment. Also there arises an advantage that the restriction plate 300 will not be broken because the push-up force by the coin SC is mitigated by rotation about the stationary axis 302.

While specific embodiments of the invention have been shown and described in detail to illustrate the application of the principles of the invention, it will be understood that the invention may be embodied otherwise without departing from such principles.

What is claimed is:

1. A coin receiving device in a coin processing apparatus, the coin receiving device comprising:

a pair of rollers;

a conveyor comprising a flat belt, said flat belt being stretched around said pair of rollers and extending substantially horizontally;

a reverse rotation roller disposed above the conveyor to provide a gap of one coin or more, said reverse rotation roller being parallel with an axial line of said pair of rollers, said reverse rotation roller having a lower circumferential surface separated from said flat belt by a distance that is greater than a thickness of a coin, whereby movement of coins conveyed in a stack on the conveyor is restricted by the reverse rotation roller, said conveyor moving said coins in a conveying direction;

a receiver comprising a receiving port and a frame; and a movable restrictor fixed above the reverse rotation roller, said movable restrictor having a tip portion, said tip portion extending over said reverse roller, said movable restrictor extending upstream of said flat belt, said movable restrictor being parallel or substantially parallel with said flat belt, said movable conveyor being movable in a direction away from said conveyor, said movable restrictor being an elastic sheet, said elastic sheet having a rectangular shape portion, said rectangular shape portion having a traverse width, said traverse width being substantially equal to a width of said receiving port, said elastic sheet having an arcuate shape portion, wherein said elastic sheet has a convex shape at a center portion thereof, said arcuate portion being arranged at an upstream end of said flat belt, wherein a distance between said movable restrictor and a top surface of said flat belt is less than a diameter of a coin having the greatest diameter, one side of said reverse rotation roller being located at a position upstream of said conveyor with respect to said conveying direction, wherein at least a portion of said frame surrounds a portion of said reverse rotation roller on said one side.

2. A coin receiving device in a coin processing apparatus according to claim 1, wherein said movable restrictor is formed of a light-transmissive elastic body.

3. A coin receiving device in a coin processing apparatus, comprising:

a flat belt stretched around a pair of rollers and extending substantially horizontally;

a reverse rotation roller disposed above said flat belt, parallel with an axial line of said pair of rollers, said reverse rotation roller having a lower circumferential face separated from said flat belt by a distance which is larger than a thickness of a coin, wherein movement of coins conveyed in a stack on the conveyor is restricted by the reverse rotation roller, said coins being conveyed in a conveying direction via said flat belt;

a receiver element comprising a frame and a receiving port, said receiving port having a receiving port width; and a movable restrictor disposed adjacent to said reverse rotation roller, said movable restrictor extending in an upstream direction, relative to a coin conveying direction, of the flat belt and substantially parallel with said flat belt, said movable restrictor being an elastic sheet, said elastic sheet having a rectangular portion and an arcuate portion, said rectangular portion having a rectangular portion width, said arcuate portion and said rectangular portion being arranged above an upstream end of said flat belt, said rectangular portion width being substantially equal to said receiving port width, said arcuate portion having a center portion, said center portion has a convex shape, at least a portion of said elastic sheet being located at a position above said reverse roller, wherein a distance between said movable restrictor and a top surface of said flat belt is less than a diameter of a coin having the largest greatest diameter, at least a portion of said frame surrounding at least a portion of one side of said movable restrictor, said one side of said movable restrictor being located at a position upstream of said pair of rollers with respect to said conveying direction.

4. A coin receiving device in a coin processing apparatus according to claim 3, wherein the movable restrictor is convex, toward an upstream of the flat belt.

5. A coin receiving device in a coin processing apparatus according to claim 1, wherein the movable restrictor is replaceably attached to a frame.

6. A coin processing apparatus coin receiving device comprising:

a coin transport belt extending between a first roller and a second roller, said coin transport belt extending substantially horizontally, said coin transport belt having a downstream end and an upstream end, said first roller being arranged at said downstream end, said second roller being arranged at said upstream end;

a coin receiver element comprising a receiving port and a frame comprising an end portion, said receiving port having a receiving port width;

a reverse rotation roller disposed above said belt, said reverse rotation roller being parallel with an axial line of said first roller and said second roller, said reverse rotation roller defining a gap between a rotation roller lower circumferential face and said belt, said gap being larger than a thickness of a coin to be transported by said coin transport belt in a conveying direction, wherein movement of coins conveyed in a stack on said coin transport belt is restricted via said reverse rotation roller; and a movable restrictor disposed above said reverse rotation roller, said movable restrictor comprising an elastic sheet, said elastic sheet comprising a rectangular shaped portion and an arcuate shaped portion, said elastic sheet being disposed substantially parallel to said coin transport belt such that at least a portion of said elastic sheet is located opposite said upstream end of said coin transport belt, wherein a distance between said movable restrictor and a top surface of said coin transport belt is less than a diameter of a coin having the largest diameter, said rectangular shaped portion having a rectangular shaped portion width, said receiving port width being substantially equal to said rectangular shaped portion width, said rectangular shaped portion being in contact with said frame, said arcuate shaped portion being located at a spaced location from said frame, said arcuate portion comprising a center portion, said center portion having a convex shape, said elastic sheet being replaceably attached to said frame, said end portion surrounding at a least a portion of said reverse rotation roller on one side of said reverse rotation roller, said one side of said reverse rotation roller being located at a position upstream of said second roller with respect to said conveying direction, said elastic sheet being connected to said frame, wherein said elastic sheet is movable in a direction away from said conveyor.

7. A coin processing apparatus coin receiving device according to claim 6, wherein:

said movable restrictor extends in an upstream direction, relative to a coin conveying direction of said coin transport belt.

8. A coin receiving device in a coin processing apparatus according to claim 6, wherein the movable restrictor is detachably attached to a frame.

9. A coin receiving device in a coin processing apparatus according to claim 6, wherein said movable restrictor is formed of an elastic body.

10. A coin receiving device in a coin processing apparatus according to claim 6, wherein said elastic body is light-transmissive.

11. A coin processing apparatus in accordance with claim 6, wherein said end portion comprises a bent portion, said bent portion being arranged on said one side of said reverse rotation roller, wherein said bent portion is located opposite said reverse rotation roller, said movable restrictor extending in a direction opposite said conveying direction.

12. A coin processing apparatus in accordance with claim 11, further comprising a holder element, said holder element comprising at least one hook element, wherein said frame has at least one frame hole, said movable restrictor comprising at least one movable restrictor hole, said at least one hook element extending through said at least one movable restrictor hole and said at least one frame hole, said hooking element being in contact with said frame, wherein said elastic sheet is detachably connected to said frame via said holder element, at least a portion of said movable restrictor element being arranged between said holder element and said frame.

13. A coin processing apparatus in accordance with claim 6, further comprising a holder element, said holder element comprising at least one hook element, wherein said frame has at least one frame hole, said movable restrictor comprising at least one movable restrictor hole, said at least one hook element extending through said at least one movable restrictor hole and said at least one frame hole, said hooking element being in contact with said frame, wherein said elastic sheet is detachably connected to said frame via said holder element, at least a portion of said movable restrictor element being arranged between said holder element and said frame.

14. A coin receiving device in a coin processing apparatus according to claim 3, further comprising a holder element, said holder element comprising at least one hook element, wherein said frame has at least one frame hole, said movable restrictor comprising at least one movable restrictor hole, said at least one hook element extending through said at least one movable restrictor hole and said at least one frame hole, said hooking element being in contact with said frame, wherein said elastic sheet is detachably connected to said frame via said holder element, at least a portion of said movable restrictor element being arranged between said holder element and said frame.

15. A coin receiving device in a coin processing apparatus according to claim 1, further comprising a holder element, said holder element comprising at least one hook element, wherein said frame has at least one frame hole, said movable restrictor comprising at least one movable restrictor hole, said at least one hook element extending through said at least one movable restrictor hole and said at least one frame hole, said hooking element being in contact with said frame, wherein said elastic sheet is detachably connected to said frame via said holder element, at least a portion of said movable restrictor element being arranged between said holder element and said frame.

* * * * *

UNITED STATES PATENT AND TRADEMARK OFFICE

CERTIFICATE OF CORRECTION

PATENT NO. : 7,806,756 B2
APPLICATION NO. : 11/610079
DATED : October 5, 2010
INVENTOR(S) : Masayoshi Umeda It is certified that error appears in the above-identified patent and that said Letters Patent is hereby corrected as shown below:

On the Title page, item [73] should read:

--(73) Assignee: Asahi Seiko Co., Ltd., Tokyo (JP)--.

Signed and Sealed this

Twenty-third Day of November, 2010

David J. Kappos

David J. Kappos
*Director of the United States Patent and Trademark Office*